US006321427B1

(12) United States Patent
Auguste et al.

(10) Patent No.: US 6,321,427 B1
(45) Date of Patent: Nov. 27, 2001

(54) KNIT-DEKNIT YARN AND METHOD AND APPARATUS FOR MAKING SAME

(75) Inventors: Jean-Claude Auguste, Dayton, TN (US); Fred Chiles, Dalton, GA (US); Wilbert E. Fink, Villanova, PA (US)

(73) Assignee: Polyloom Corporation of America, Dayton, TN (US)

( * ) Notice: Subject to any disclaimer, the term of this patent is extended or adjusted under 35 U.S.C. 154(b) by 0 days.

(21) Appl. No.: 09/392,260

(22) Filed: Sep. 9, 1999

(51) Int. Cl.[7] ..... D04B 19/00
(52) U.S. Cl. ..... 28/218; 28/220; 28/247
(58) Field of Search ..... 28/218, 217, 219, 28/220, 247, 258, 171; 57/208, 246; 66/1 R

(56) References Cited

U.S. PATENT DOCUMENTS

| | | | | |
|---|---|---|---|---|
| 2,857,651 | * | 10/1958 | Keen | 28/218 |
| 3,496,259 | | 2/1970 | Guenther . | |
| 3,496,260 | | 2/1970 | Guenther et al. . | |
| 3,579,764 | * | 5/1971 | Kieffer | 28/218 |
| 3,720,984 | * | 3/1973 | Roberson, Jr. | 28/218 |
| 3,997,950 | * | 12/1976 | Gibson | 28/218 |
| 4,005,569 | | 2/1977 | Corbiere . | |
| 4,137,615 | * | 2/1979 | Webster | 28/218 |
| 4,181,762 | * | 1/1980 | Benedyk | 28/218 |
| 4,870,839 | * | 10/1989 | Odham | 66/125 A |
| 5,160,347 | | 11/1992 | Kay et al. . | |

FOREIGN PATENT DOCUMENTS

| | | | | |
|---|---|---|---|---|
| 23290 | * | 5/1988 | (JP) | 28/218 |

OTHER PUBLICATIONS

Manual: Model 6–CK Circular Knitting Machine, L–R Machine Sales, Inc., Chickamauga, Georgia 30707.
Manual: Model CY–600 Lab–Knit, Speizman Industries, Inc., Charlotte, North Carolina 28201.

* cited by examiner

*Primary Examiner*—Amy B. Vanatta
(74) *Attorney, Agent, or Firm*—Burns, Doane, Swecker & Mathis, L.L.P.

(57) ABSTRACT

An improved heavy denier fibrillated polymer carpet yarn is densely knit, deknit and heat treated. An improved carpet face yarn is provided in an omnidirectional carpet pile.

7 Claims, 4 Drawing Sheets

KNIT-DEKNIT YARN AND METHOD AND APPARATUS FOR MAKING SAME

BACKGROUND

Knit-deknit yarns have been used as carpet face yarns to provide body and texture in carpet products produced therefrom.

Conventional methods for making such yarn involve knitting an extruded, fibrillated polyolefin tape yarn into a sock on a circular knitting machine. The sock is then heat treated to heat set kinks in the yarn of the knitted sock. The yarn is then deknit and wound for shipment. In use, the yarn may be formed into carpet, for example, by conventional tufting techniques and heat treated to cure the backing.

Conventionally, knit-deknit carpet yarns are of 5000 Denier ("D") or less. A typical product is 2200 D yarn knitted with 18 needles on a 90 slot, 6.25" diameter knitting machine such as an UNRAV CY-600, or an L-R Machine Model 6-CK circular knitting machine from Larry Rankin Machinery Co. On occasion, heavier product has been known in the prior art, i.e. a 5700 D product knitted with 30 needles, a 5000 D product knitted with 45 needles a 7,600 high density polyethylene yarn knitted with 22 needles and a 10,000 yarn knitted with 15 needles.

While these prior art yarns were acceptable for use in carpets, a need exists for yarns which would provide improved face yarns, particularly in high-end carpet products such as artificial turf sports surfaces.

OBJECTS AND SUMMARY OF THE INVENTION

It is an object of the present invention to provide a heavier grade of polymer carpet yarn having a heat set topology suitable for carpet products.

It is another object of the present invention to provide a yarn for carpet product having a dense, attractive yarn pile surface.

It is another object of the present invention to provide a carpet yarn having a non-directional, highly resilient pile.

It is another object of the present invention to provide methods and apparatus for making such yarns.

Applicants' initially believed that yarn of Denier greater than about 5700 (particularly relatively stiff polypropylene yarn) could not be densely knit and commercially produced on conventional knitting machines, at a needle count of greater than 22 on a 6.25 inch diameter circular knitting machine. However, applicants demonstrated that a fibrillated polymer yarn of, for example, 7600 D could be knitted into a sock at a needle count of 30. A conventional yarn lubrication applicator and conventional sock take-up machinery was provided with variable speed and tensioning to inhibit needle breakage in the knitting machine.

The resulting sock is densely knitted. The sock is heat treated to produce a heavy denier product with a high number of kinks per inch. The yarn is wound during which a twist may be imparted and the kinks straightened. When formed into carpet and heat-treated, the yarn blooms and produces a cut pile with a novel upper surface characterized by a dense array of yarn fibril ends having essentially random orientation. The carpet product also exhibits high resilience.

Preferred embodiments of the present invention include a process for making a carpet yarn. A fibrillated polyolefin yarn greater than 7000 in Denier; and preferably 7600 D to 8000 D is used. For example, the yarn may be 8000 D extruded polypropylene tape, 700 mils wide and 2.1 mils thick, slit to produce a fibrillated yarn. However, deniers of above 10,000, for example 11,000 D or 12,000 D may be used.

The yarn is knitted into a fabric or sock using a needle spacing less than one inch, preferably less than ⅔ of an inch. The sock is heat treated following which the sock is de-knitted.

Advantageously the process is performed using a 90 needle slot, circular knitting machine set up with 30 needles. Typically, such a circular knitting machine is a 6.25 inch diameter machine with a circumferential needle spacing of about 0.65" or less.

The knitting may result in a knitted sock with a loop width of about 0.25 inches. Advantageously, the yarn is heat set in sock form, deknitted, wound, transported to the carpet manufacturing line, unwound and tufted as face yarn in a pile carpet. The carpet is further heat treated which restores the general kinked form of the yarn.

The present invention is also a carpet yarn of at least 7000 D extruded, fibrillated polyolefin tape having at least two kinks per inch of yarn in the finished carpet.

A further aspect of the invention is an apparatus for making the novel yarns disclosed herein. A preferred embodiment of the apparatus includes a supply of polymer yarn of at least 7000 D. The yarn is lubricated in a conventional fashion and fed to a multi-needle circular knitting machine where it is knitted into a sock preferably having a stitch length less than about one inch. A variable drive pull roller of a type known in the art is employed to pull the sock from the knitting machine at a selectable speed and tension to inhibit breakage of the knitting machine needles. An autoclave is used to heat treat the sock at for example 230° F. The yarn sock is deknitted after heat treatment and wound. After tufting, the yarn is further heat treated causing it to take on a repeating curvilinear form, especially a generally sinusoidal form. In preferred embodiments, the yarn in the finished carpet product has a repeat length or wavelength $\lambda$, approximately equal to or less than the pile height of the carpet.

The foregoing is intended as a convenient summary of subject areas described in this patent specification. However, the invention to be protected is defined by the claims herein.

DETAILED DESCRIPTION OF THE DRAWINGS

Figure 1:
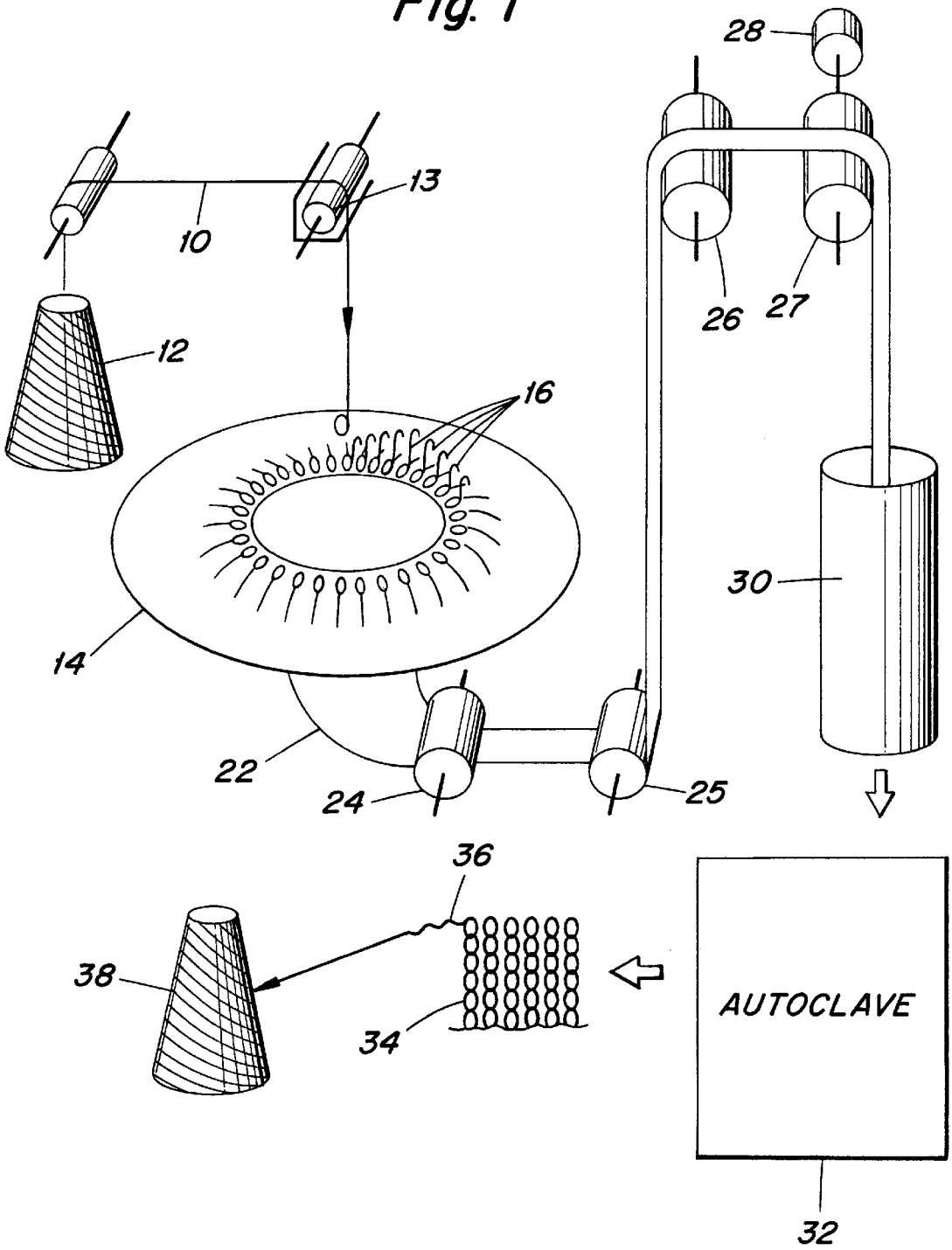
FIG. 1 is a diagram illustrating apparatus and processes of the present invention for making heavy denier, densely knit-deknit yarn.

FIG. 1 is a diagram illustrating apparatus and processes of the present invention for making heavy denier, densely knit-deknit yarn. Dimensions and proportions have been exaggerated in the Figure for illustration purposes and non-essential detail has been eliminated.

A supply of high denier extruded polymer tape yarn 10 is indicated by the yarn cone 12. In preferred embodiments, the yarn is a fibrillated polypropylene tape yarn, the making of which is described in U.S. Patent Nos. 3,496,259 and 3,496,260 to Guenther et al. The yarn is greater than 7000 D, more particularly between 7000 D and 10,000 D, most preferably between 7600 D to 8000 D.

The yarn advances in the direction indicated to a circular knitting machine 14. In preferred embodiments the knitting machine is a 6.25 inch diameter machine, with 90 needle slots. An example of such a machine is the L-R Machine Model 6-CK. Typically, such machines are used for knitting low denier yarn, for example 1000–1300 denier filament yarn with 90 or 60 needles. The highest denier exemplified by the manufacturer is 3700 Denier Filament Yarn, knit with 30 needles (one needle every third slot).

At their base needles 16 fit in a slot formed by top and bottom cams that are secured in a rotating base—as that base rotates the needles are moved up and down. The needle slots are spaced equally in a circle. In a machine with a circumference of 19.6821 inches, the centerline needle spacing is about 0.2187 inches when 90 needles are used. Leaving out needles alters the dimensions. The slot (gap) formed by the cams that raise and lower the needles is set at 0.24 inches. The calculated stitch length for the 30 needle 7600 denier yarn is 0.973 inches. This stitch length may decrease slightly during heat treatment due to yarn shrinkage (yarn shrinkages of 6 to 8% are typical).

Each needle in succession is lifted up by the bottom cam in the rotating base. During the first revolution the needle is raised and the keeper drops down opening the needle eye to grasp the first thread at the top of its up stroke. The needle then begins its down stroke closing the keeper as it is pulled down to the bottom of the down stroke (by the top cam) and then pushed back up to its holding position (by the bottom cam) to await the next full revolution of the cam slot. During the next rotation the needle is again lifted by the bottom cam and as it rises up the keeper opens and the yarn loop in residence slides down the needle. At the top of the up stroke the needle is free to grasp another portion of the yarn and begin its next down stroke closing the keeper and pulling the new loop through the loop already in residence as it completes the down stroke. It then rises back to its holding position.

As shown in FIG. 1, the yarn 10 may be lubricated at applicator 13 before reaching the knitting machine. The knitting machine is set up with 30 needles 16 (one needle every third slot). The needles move up and down as the base of the knitting machine rotates to knit a sock 22 from the heavy denier yarn. It will be understood that different needle numbers and positions may be selected to vary the stitch dimensions.

Figure 2:
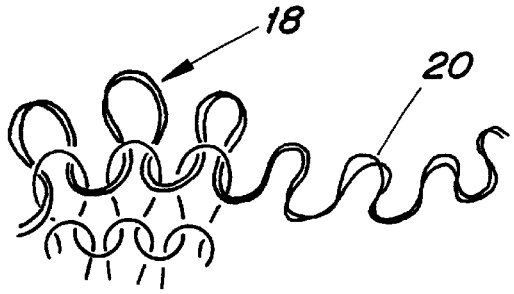
FIG. 2 illustrates a portion of a knitted sock such as employed in embodiments of the present invention.

FIG. 2 is illustrative of a stitch or loop pattern which may be used to make the sock, a portion 18 of which is shown in the Figure. The stitch pattern is selected so that the sock may be readily deknit by pulling on an end 20 of the yarn.

Referring once more to FIG. 1, the knitted sock 22 exits the bottom of the circular knitting machine 14. Rollers 24, 25, 26 and 27 direct and pull the sock into a collection bag 30. Roller 27 is provided with a variable drive 28 which is used to adjust the take-off speed of and tension on the sock 22.

Typically 10 to 20 lbs. of knitted sock is collected in the collection bag 30 and then heat treated in an autoclave 32 to heat set kinks produced by the knitting process. A typical heat set temperature may be about 230° F. for polyethylene yarns. For polypropylene the heat set temperature may be between 240° to 290° F., more preferably between 255° F. to 260° F.

The heat set process, as the term implies, sets a permanent memory in the yarn. The remembered form is of repeating kinks, repeating open loops or repeating partial loops. The yarn may be straightened and then recover a knitted, crimped pattern when it is again heated.

After the heat setting step, the sock is unwound from the sock onto a conventional yarn cone or tube with enough tension to pull the yarn flat as it is wound onto a spool of finished yarn. The yarn is then put on a tufting machine where it is handled like any other carpet yarn in the tufting process. The resulting greige goods carpet generally shows only a small amount of the crimped pattern in the face carpet fiber.

Once the carpet goes into the carpet coating process and is heated to dry the latex backing material (for example in an oven), the face yarn responds to the heat by returning to a crimped pattern similar to the one earlier heat set into the yarn. In other words, the yarn "blooms", i.e. recovers or remembers its sinusoidal form. The resulting heat-treated carpet has a distinctive non-directional appearance.

Figure 6:
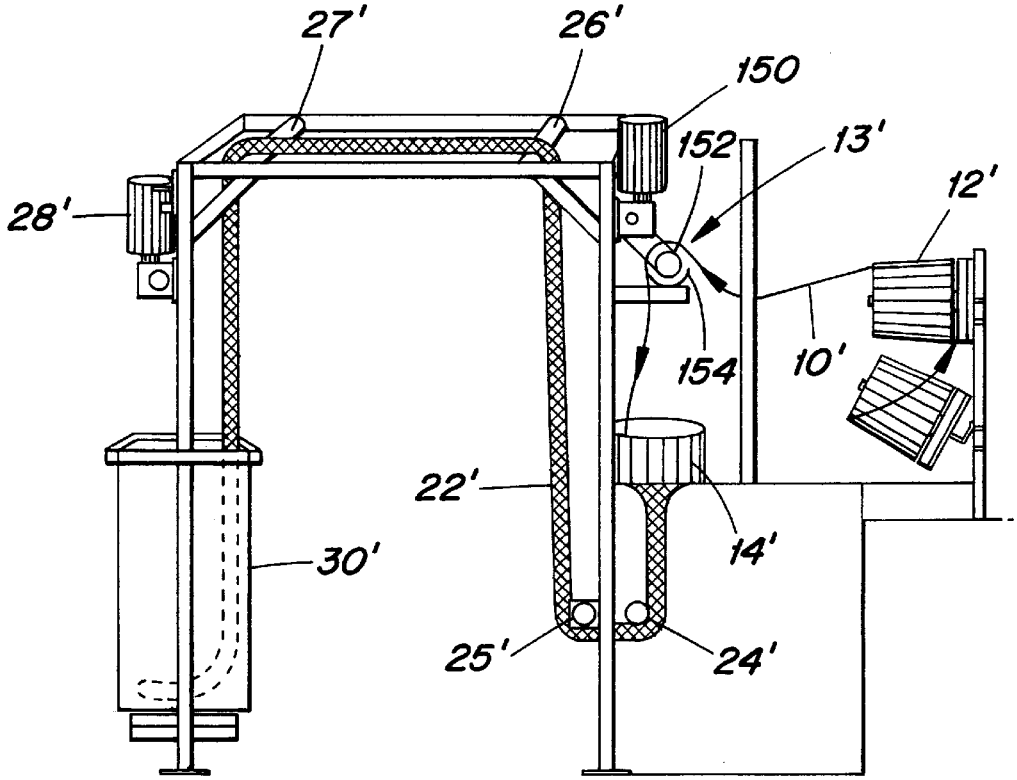
FIG. 6 is a side pictorial view in partial cross section of an apparatus for producing a yarn sock in accordance with the present invention.

FIG. 6 illustrates in greater detail certain aspects of the machinery associated with the knitting process. The knitting is aided by lubricating the yarn with a suitable spin finish. For example, a diluted solution of silicone in water may be used. Alternatively, a clear oil may be used.

The finish applicator system that applies either the silicone or oil type spin finish is shown at 13'. The finish applicator may be located directly above and before the head of the knitting machine 14'. The applicator uses a variable speed drive motor 150 driving a coating roll 152 that revolves in a spin finish reservoir 154. The yarn travels over the top part of the rotating coating roll 152 before going down into the knitting machine 14'. The heavier denier twisted yarns are round and the surface area that contacts the coating roll 152 is smaller than the contact area of lower denier flat tape type yarn. By increasing the coating roll speed a heavier weight of coating can be applied to the twisted yarn. The finish applicator system may be used to apply a heavier weight of coating then would be applied by a stationary roll or a brush device. Lubrication is critical at the point where a new stitch is pulled through an existing stitch and where the heavier denier yarn is pulled down through the needle slot to exit the knitting head.

With regard to the knitting machine, the rotational speed has been reduced from the typical 250 RPM to 190 RPM. At the higher speed the stress on the needles is extreme and the machines can be run for only short periods of time before severe needle breakage occurs requiring the machine to be shutdown to replace broken needles.

As the sock is knit it is important that the sock being formed continues to move down and away from the knit head. Small denier yarn socks literally fall away out of the machine, i.e. pulling is assisted by the weight of the sock hanging below the knit head. When yarn denier is increased the yarn tends to fill the space in the needle slot. This makes it more difficult to pull the new stitch through the one in residence and it also becomes harder for the developing sock to make its exit from the knitting head.

The process catastrophically fails if the needle cannot open the keeper and release the last loop on its up stroke to begin a new loop. It will also fail if upon grasping the new loop it cannot pull it down and through the preceding yarn loop. The needle slot must be evacuated by the forming sock or the rotating cams that form the cam slot will push or pull the needle until the needle breaks (often breaking most of the needles in the machine before it can be stopped).

Accordingly, a variable speed pull roll system is employed. Roll 27' is powered by motor and adjustable drive 28'. Through the use of the rollers 24', 25', 26' and 27' the sock 22' is first pulled downwardly from the knitting machine 14' then upwardly over rolls 26' and 27' and finally deposited in the collection bag 30'.

Figure 3:
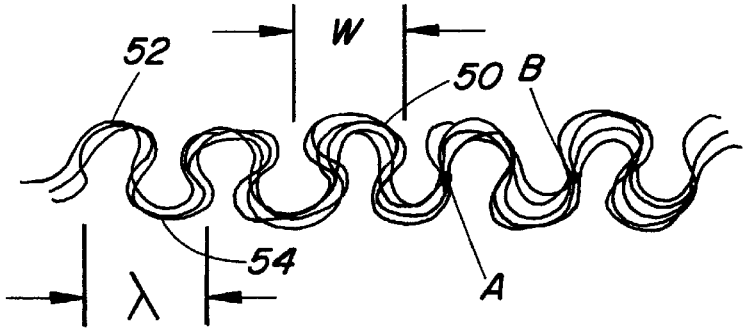
FIG. 3 illustrates a length of relaxed, deknit yarn, illustrating dimensions of a preferred embodiment of the present invention.

Yarn in accordance with the present invention is shown in FIG. 3 and is characterized by certain dimensions. In the example, the yarn is 7600 D, knit with a needle to needle spacing of about 0.64".

The yarn in FIG. 3 is shown in a deknit, relaxed condition (i.e. the ends are not under tension). The yarn takes on an approximately sinusoidal form, a full wave of which consists of a upward kink 52 and a downward kink 54. The sinusoid in the relaxed configuration of the yarn may be characterized by dimension or wavelength λ. It will be understood that this dimension is dictated at least in part by the density of the knitting. In preferred embodiments, the value of λ is less than 0.5 inch more preferably less than 0.25 inch which translates into at least about 2 kinks per linear inch (extended length of the yarn).

It will be understood that the value of λ depends on the tension on the yarn. In the example of FIG. 3, the initial λ value as the sock is knitted is approximately equal to the needle spacing, i.e. 0.65 inches. However, the diameter of the sock contracts after knitting resulting in a λ in the knitted sock of about 0.25 to 0.5 inches. After contraction, the edge to edge loop width W is less than 0.25 inches. The yarn is also characterized by a sock stitch length (the distance along the yarn from point A to point B) which, in the example of FIG. 3 is about 0.97 inches. When the yarn is wound, the kinks are essentially straightened thereby increasing the wavelength λ to nearly the stitch length.

Figure 4:
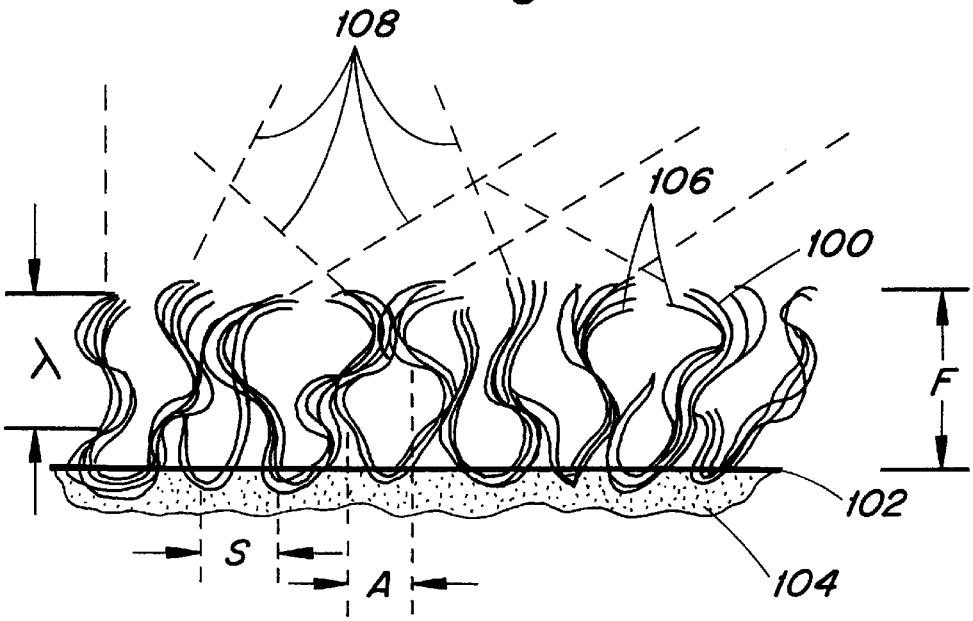
FIG. 4 is a side view of a tufted carpet made with heavy denier, densely knit-deknit yarn in accordance with aspects of the present invention.
Figure 5A:
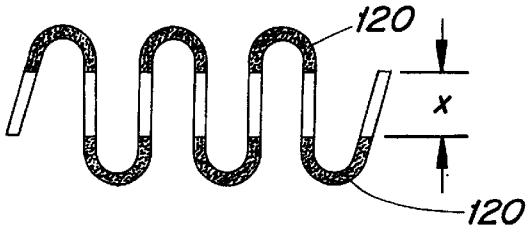
FIG. 5 is a side view of various yarns illustrating the location of various curvilinear portions.
Figure 5B:
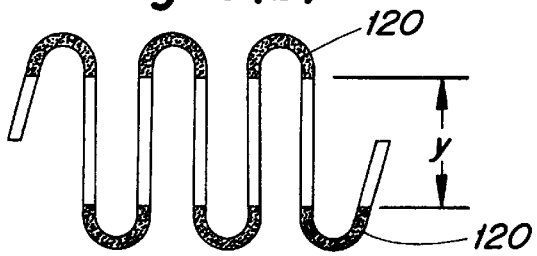
Figure 5C:
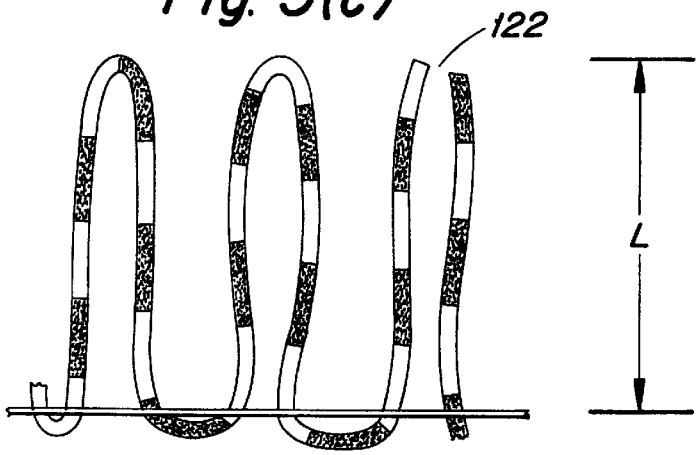
Figure 5D:
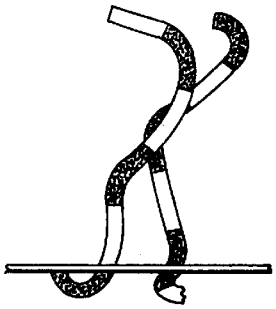
Figure 5E:
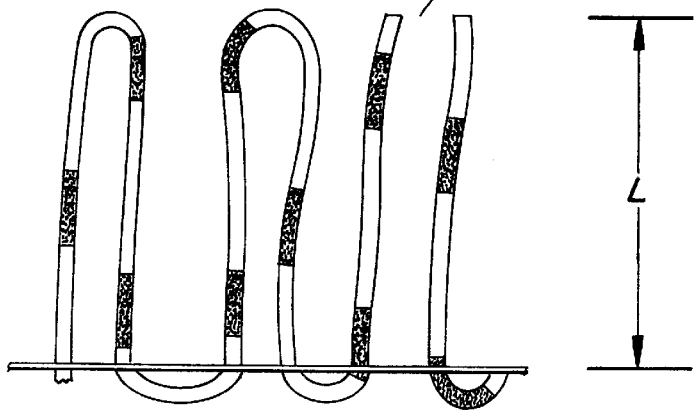
Figure 5F:
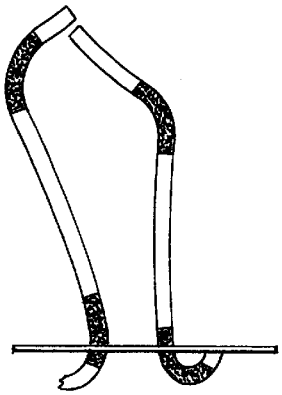

FIG. 4 is a cross-sectional view of a cut pile carpet made with heavy denier, dense knit-deknit yarn 100 in accordance with the teachings of the preferred embodiment of the present invention. The yarn may be tufted through a backing 102. The tufts are separated by sufficient space to permit the yarn to bloom when the carpet is heat treated. Advantageously, this separation S is comparable to the amplitude A of the tufted yarn. An adhesive coating or extruded sheet 104 is provided to bind the tufts in place. However, it will be understood that the yarn of the present invention may be used as the face yarn in other known carpet constructions and products.

After heat treatment, the carpet in FIG. 4 is characterized by a finished pile height F. Advantageously, the pile height is at least as great as the λ value of the yarn after heat treating. The resulting carpet has a dense array of fibril ends 106 ( for example 18 to 20 per tape). As shown in FIG. 4, the end of the yarn segments making up the pile have a great variety of orientations. This is illustrated by the dashed lines 108, which are drawn tangent to the principle axes of the yarn segment ends. As a result the pile is omnidirectional, i.e. it appears to have approximately the same texture, regardless of the angle from which it is viewed. Because of the sinusoid shape of the yarn segments, the pile in the finished carpet has a dense, attractive surface.

The effect of employing more needles in the knitting process is illustrated in FIG. 5. A yarn made using a relatively high needle density is shown in FIG. 5(*a*). The shaded regions 120 of the yarn are regions where a curvilinear shape is formed during knitting and then heat set. These regions are separated by relatively short, substantially straight segments of length x. In contrast, a yarn made with relatively less needle density (about half in the example) has longer substantially straight segments of length y (about twice as long in the example). It will be understood that, for a given carpet pile height L, the yarn of FIG. 5(*a*) will provide more bloom than the yarn of FIG. 5(*b*), which, in contrast, will produce tufts with more vertically upstanding yarn regions.

This effect is illustrated in FIGS. 5(*c*) and (*d*). In FIG. 5(*c*), the yarn of FIG. 5(*a*) is tufted into backing. Tension in the winding and tufting process has temporarily straightened most of the shaded curvilinear regions. A tuft is shown cut at 122. After heat treatment, the cut yarn blooms as indicated in FIG. 5(*d*).

In FIG. 5(*e*), the yarn of FIG. 5(*b*) is tufted into a backing to produce approximately the same pile height L as in FIG. 5(*c*). A tuft of this lower needle density yarn is shown cut at 124. After heat treatment, the cut yarn retains more vertically upstanding length as indicated in FIG. 5(*f*).

The yarn of the present invention provides better coverage (or bulk) in that it spreads out more in the finished carpet giving the carpet a fuller appearance then the same weight of straighter yarn. Accordingly, the face weight can be reduced without a loss of good appearance. The carpet also has a somewhat more resilient feel to it as it is walked upon, particularly as the face weight of carpet is increased.

The non-directional feature is particularly valuable in sports applications. This feature provides ease and consistency of footing irrespective of the directional orientation of the carpet in sports fields such as baseball, football or soccer fields. In surfaces for golf greens, practice putting greens, miniature golf links and lawn bowling lanes, the yarns and carpet facilitate improved ball roll because the carpet does not have a grain or bias in any one direction that might tend to influence the way a ball rolls.

The foregoing is intended as a description of preferred embodiments of the present invention. However, the scope of the invention claimed is defined by the literal language of the following claims and equivalents thereof.

We claim:

1. A process for making a carpet face yarn comprising:

providing a fibrillated polypropylene yarn greater than 7000 in Denier;

knitting the yarn on a knitting machine with a needle spacing less than 0.75 inch to form a knitted fabric;

pulling the knitted fabric from the knitting machine;

heat treating the knitted fabric to set the yarn in a kinked form with a stitch length less than about one inch;

deknitting the fabric; and heat treating the yarn in situ in the carpet.

2. The process of claim 1, wherein the yarn is knit into a sock on a circular knitting machine with a circumferential needle spacing of less than 0.67 inch.

3. The process of claim 2, wherein the yarn in the sock is heat set into an approximately sinusoidal form having a wavelength λ of about 0.5 inches or less.

4. The process of claim 3, wherein the deknitted yarn is wound.

5. The process of claim 4, wherein the deknitted yarn is essentially straightened during winding.

6. The process of claim 1, wherein, after heat treatment in situ the yarn has a generally sinusoidal form and wherein the pile height of the carpet above the backing is at least as great as the wavelength, λ, of the yarn after the carpet is heat treated.

7. The process of claim 1, wherein the yarn is from 7600 D to 8000 D.

* * * * *